US007993090B2

(12) United States Patent
Yoshikawa

(10) Patent No.: US 7,993,090 B2
(45) Date of Patent: Aug. 9, 2011

(54) WORKING MACHINE WITH STRUCTURE FOR ASSEMBLING BOOM THEREOF

(75) Inventor: Takuya Yoshikawa, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 146 days.

(21) Appl. No.: 12/425,619

(22) Filed: Apr. 17, 2009

(65) Prior Publication Data

US 2009/0304485 A1 Dec. 10, 2009

(30) Foreign Application Priority Data

Jun. 4, 2008 (JP) ..... 2008-147351

(51) Int. Cl.
*E02F 3/42* (2006.01)

(52) U.S. Cl. ..... 414/694; 29/33 R; 29/891; 29/897.2; 414/680

(58) Field of Classification Search ..... 414/680, 414/694, 722, 723; 172/272; 37/417, 468; 29/33 R, 891, 897.2
See application file for complete search history.

(56) References Cited

U.S. PATENT DOCUMENTS 4,393,607 A * 7/1983 Hirosawa ..... 37/443

FOREIGN PATENT DOCUMENTS

JP 64-28452 2/1989
JP 2535667 2/1997

* cited by examiner

*Primary Examiner* — Donald Underwood
(74) *Attorney, Agent, or Firm* — Oblon, Spivak, McClelland, Maier & Neustadt, L.L.P.

(57) ABSTRACT

Bosses extending in the boom width direction are provided in a front end part of a main boom body rotated upward, and hooks opening downward are provided in a base end part of a front boom body rotated downward. In a state that the bosses and the hooks are engaged with each other, a scooping action is performed so as to match pin holes thereof. The above hooks and the bosses are arranged so as to satisfy a condition that in a state that an angle between both boom bodies is a maximum angle at the time of work, the hooks and the bosses are moved away from each other and a distance between the hooks and the bosses is increased as the angle is reduced from the maximum angle.

2 Claims, 5 Drawing Sheets

WORKING MACHINE WITH STRUCTURE FOR ASSEMBLING BOOM THEREOF

BACKGROUND OF THE INVENTION

1. Field of the Invention

The present invention relates to a working machine to which a structure for assembling a division type boom is installed.

2. Description of the Related Art

An attachment of a working machine for demolishing buildings, collecting and loading rubble, crushing stones and the like is replaced by other attachment which has a different specification in accordance with a work object (such as demolition, rubble collection and loading), work height (such as a high place and a low place) and the like (refer to Japanese Utility Model Laid-Open No. Sho64-28452).

For example, when a demolition work or the like is performed on a low rise structure, a first attachment A1 having a fundamental separate specification which is a basic specification shown in FIG. 6A is used. When the demolition work or the like is performed on a middle rise structure, a second attachment A2 having an extension separate specification shown in FIG. 6B is used.

As a common configuration among both the first and second attachments A1 and A2, an arm 2 is attached to a front end of a boom 1, a working device (a crusher shown in the figure or a backhoe bucket) 3 is attached to a front end of the arm 2, and a base end part of the boom 1 is attached to a base machine B so as to be raised and lowered around a boom foot pin 4.

The reference numeral 5 denotes a first boom cylinder (a raising and lowering cylinder) provided between the base machine B and the boom 1 for raising and lowering the entire attachment. The reference numeral 6 denotes an arm cylinder provided between the boom 1 and the arm 2 for rotating the arm 2. The reference numeral 7 denotes a working device cylinder provided between the arm 2 and the working device 3 for rotating the working device 3.

In the case of the first attachment A1 in FIG. 6A, the boom 1 is formed by a main boom body 8 on the base end side, and a front boom body 10 coupled to a front end of the main boom body 8 to rotate around a horizontal pin (hereinafter, referred to as a rotation spindle) 9. The front boom body 10 is rotated and folded into a reverse V shape by a second boom cylinder 11 provided between both the boom bodies 8 and 10.

In the second attachment A2 in FIG. 6B, one or more extension boom body 12 (a description will be given to a case of a single extension boom body shown in the figure) is fixed and connected to the main boom body 8 of the first attachment A1 with horizontal pins 13 and 14 on the upper and lower sides in a state that the boom is horizontal. The extension boom body 12 and the front boom body 10 are coupled to each other by the rotation spindle 9, and the second boom cylinder 11 is attached between the extension boom body 12 and the front boom body 10.

A structure of connecting the main boom body 8 and the extension boom body 12 at the time of assembling the second attachment A2 in FIG. 6B or at the time of replacing the first attachment A1 by the second attachment A2 in such a working machine is already shown in Japanese Utility Model No. 2535667.

The above conventional technique is proposed as a structure for connecting the extension boom body 12 to the main boom body 8 in FIG. 6B.

That is, hooks opening upward are provided in a front end part of the main boom body 8, and bosses horizontally extending in the boom width direction are provided in a base end part of the extension boom body 12. In a state that the above hooks and the bosses are engaged with each other, by a "scooping action" of rotating the main boom body 8 upward by the first boom cylinder 5, the extension boom body 12 is rotated in the gradually lowering direction (downward rotation) around a center of the bosses so as to match the upper and lower pin holes with each other.

However, the above conventional technique has a structure that movement of the main boom body and the extension boom body in the folding direction is prevented by the hooks and the bosses. Therefore, when the above structure is used as a connection structure for the main boom body 8 in FIG. 6A or the extension boom body 12 in FIG. 6B and the front boom body 10, the pin holes can be matched but it is possible neither to assemble the second boom cylinder 11 nor to perform work after the connection.

In the conventional technique, it is not possible to facilitate pin hole matching and ensure a folding action for the boom at the same time. Therefore, the conventional technique cannot be applied as a technique for connecting the front boom body.

In addition, there is no other conventionally effective technique with regard to the pin hole matching at the time of connecting the front boom body.

Therefore, the pin hole matching at the time of connecting the front boom body is very troublesome.

SUMMARY OF THE INVENTION

It is an object of the present invention to provide a working machine with a structure for assembling a boom thereof capable of facilitating pin hole matching at the time of connecting first and second boom bodies (the main boom body or the extension boom body and the front boom body in the above description) to each other with a single pin (the rotation spindle in the above description) to relatively rotate, and at the same time ensuring a folding action for the boom after connection.

The present invention is a working machine with a structure for assembling a boom thereof, the structure comprising a first boom body, a second boom body connected to a front end part of the first boom body rotated by a first boom cylinder with a pin inserted into pin holes of both the boom bodies to relatively rotate around the pin so as to be folded, a second boom cylinder provided between both the boom bodies for rotating and folding the second boom body into a reverse V shape relative to the first boom body, and bosses provided in the front end part of the first boom body so as to extend in the boom width direction. Further, the bosses, and hooks formed in a base end part of the second boom body and opening downward, are arranged so as to satisfy the following conditions respectively:

(A) both the boom bodies are relatively rotated around a center of the bosses by a scooping action of rotating the first boom body upward by the first boom cylinder in a state that the bosses are engaged with the hooks, and thereby the pin holes of the boom bodies are matched with each other; and (B) in a state that the pin is inserted into the matched pin holes so as to connect both the boom bodies to each other and an angle between both the boom bodies is a maximum angle at the time of work, the hooks and the bosses are moved away from each other, and a distance between the hooks and the bosses is increased as the angle between both the boom bodies is reduced from the maximum angle.

According to the present invention, the boss is provided in the first boom body rotated upward (a main boom body or an extension boom body connected to the main boom body) and the hook opening downward is provided in the second boom body rotated downward (a front boom body) in a state that the pin holes are matched by the scooping action. Therefore, it is possible to easily match the pin holes at the time of connecting both the boom bodies to each other.

In addition, an arrangement condition of the hook and the boss is set as: in a state that the angle between both the boom bodies is the maximum angle at the time of work, the hook and the boss are moved away from each other, and the distance between the hook and the boss is increased as the angle is reduced from the maximum angle. Therefore, there is no fear of preventing downward rotation of the second boom body after the connection.

That is, it is possible to facilitate the pin hole matching and ensure the folding action of the boom at the same time.

DESCRIPTION OF THE PREFERRED EMBODIMENTS

A description will be given to an embodiment of the present invention with FIGS. 1 to 5.

Figure 6A:
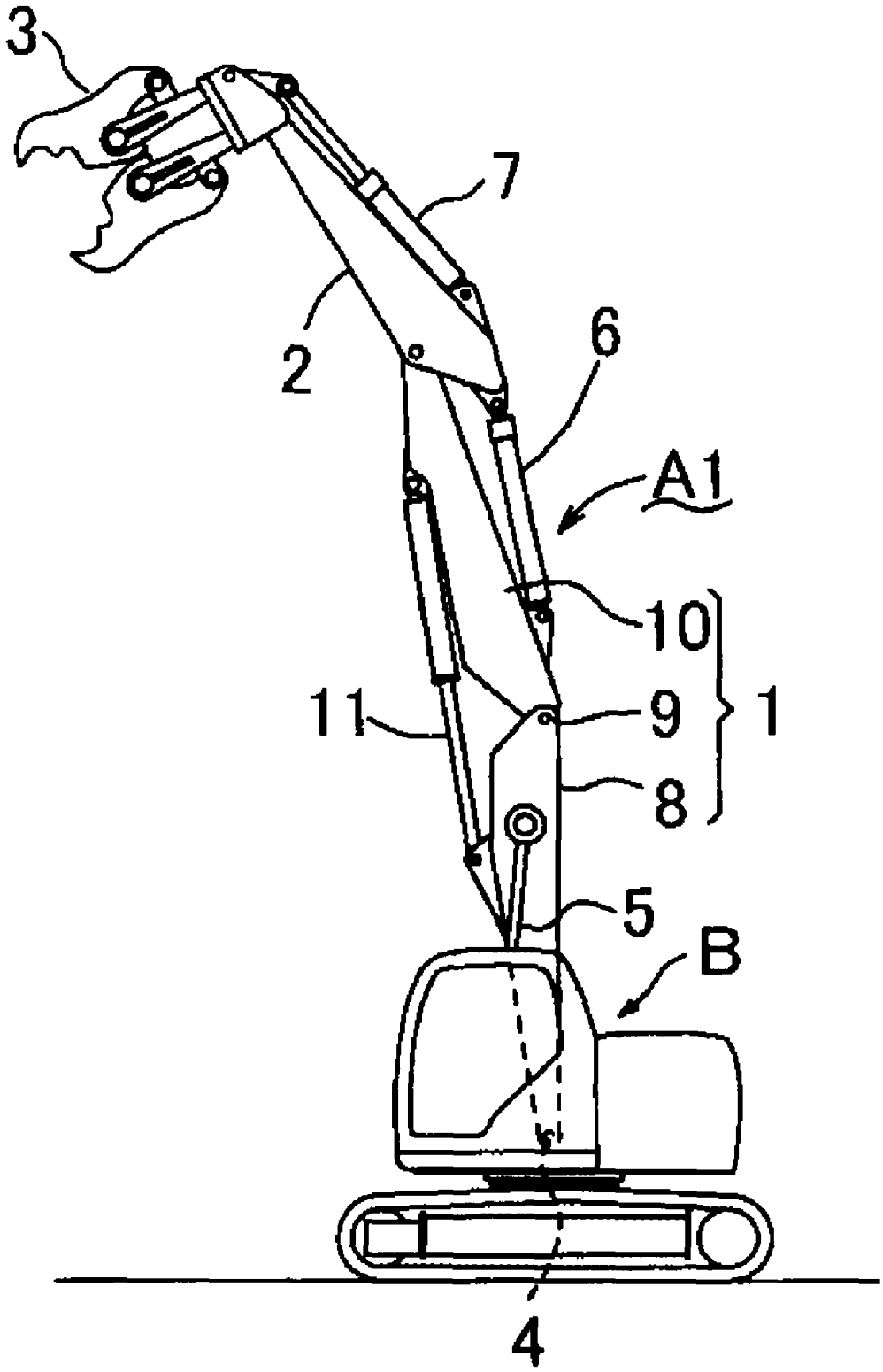
FIG. 6A is a schematic side view showing a demolition machine having a fundamental separate specification.

The embodiment shows a case where a front boom body 10 is connected to a main boom body 8 in a first attachment A1 having a fundamental separate specification shown in FIG. 6A as an example.

A pin hole 15 is provided in an upper part of a front end of the main boom body 8 and a pin hole 16 is provided in an upper part of a base end of the front boom body 10. Since a single horizontal pin 9 (a rotation spindle shown in FIGS. 3 to 5) is inserted into the above pin holes 15 and 16, both the boom bodies 8 and 10 are connected to each other to relatively rotate around the rotation spindle 9 (so that the boom can be rotated and folded).

A lower pin hole 17 is provided in a lower part of the front end of the main boom body 8. In the case where an extension boom body 12 in FIG. 6B is connected, pins 13 and 14 are inserted into the pin hole (the upper pin hole) 15 and the above lower pin hole 17.

In the present embodiment, a boss (normally, a round pin) 18 horizontally extending in the boom width direction is provided on an outer surface nearer to the base end than the upper pin hole 15 in a front end part of the main boom body 8. Meanwhile, a hook 19 opening downward is provided nearer to the base end than the upper pin hole 16 in a base end part of the front boom body 10.

Figure 6B:
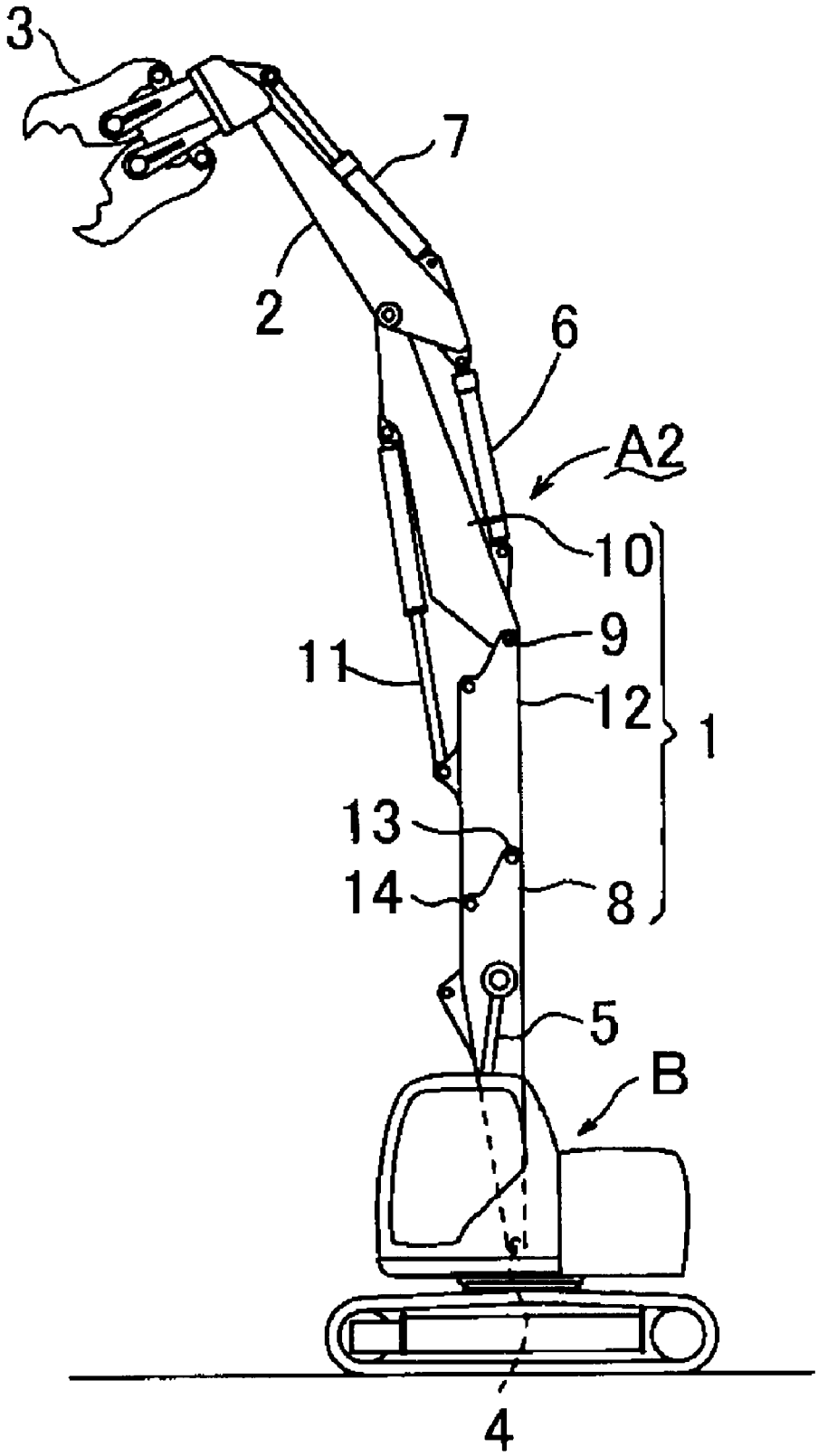
FIG. 6B is a schematic side view showing a demolition machine having an extension separate specification.

It should be noted that the main boom body 8, the extension boom body 12, and the front boom body 10 forming a boom 1 in FIGS. 6A and 6B are formed into a box shape and symmetrically connected by pins on both the left and right sides of ends thereof. Therefore, the pin holes 15 to 17, the boss 18 and the hook 19 are provided on both the left and right sides respectively. However, the left and right will not be distinguished for simplification here.

A description will be given to connection processes for both the boom bodies 8 and 12 according to the present embodiment.

Figure 1:
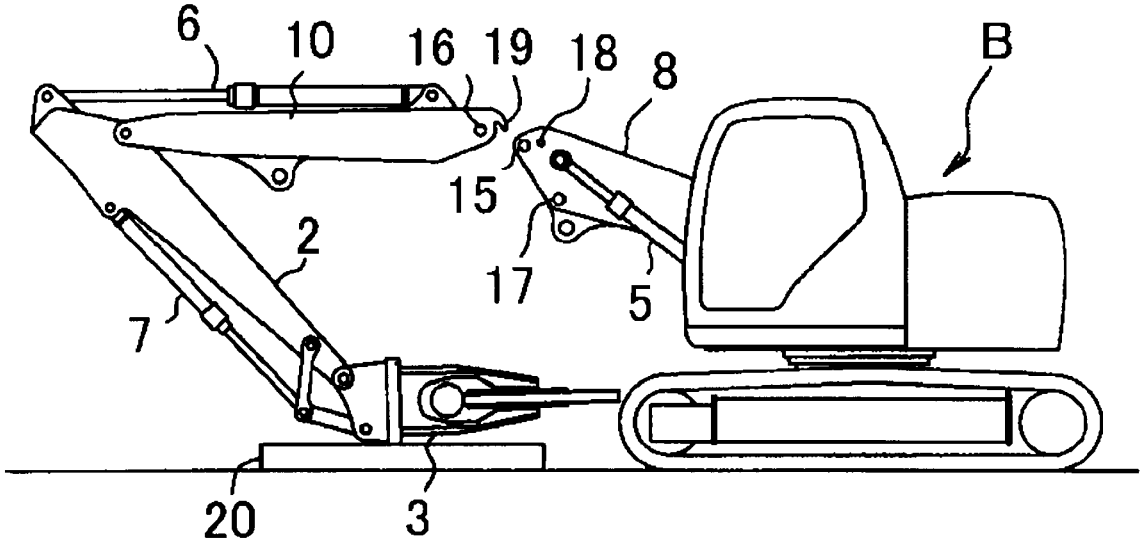
FIG. 1 is an entire side view showing a state that a main boom body and an front boom body are not yet connected to each other in an embodiment of the present invention.
Figure 2:
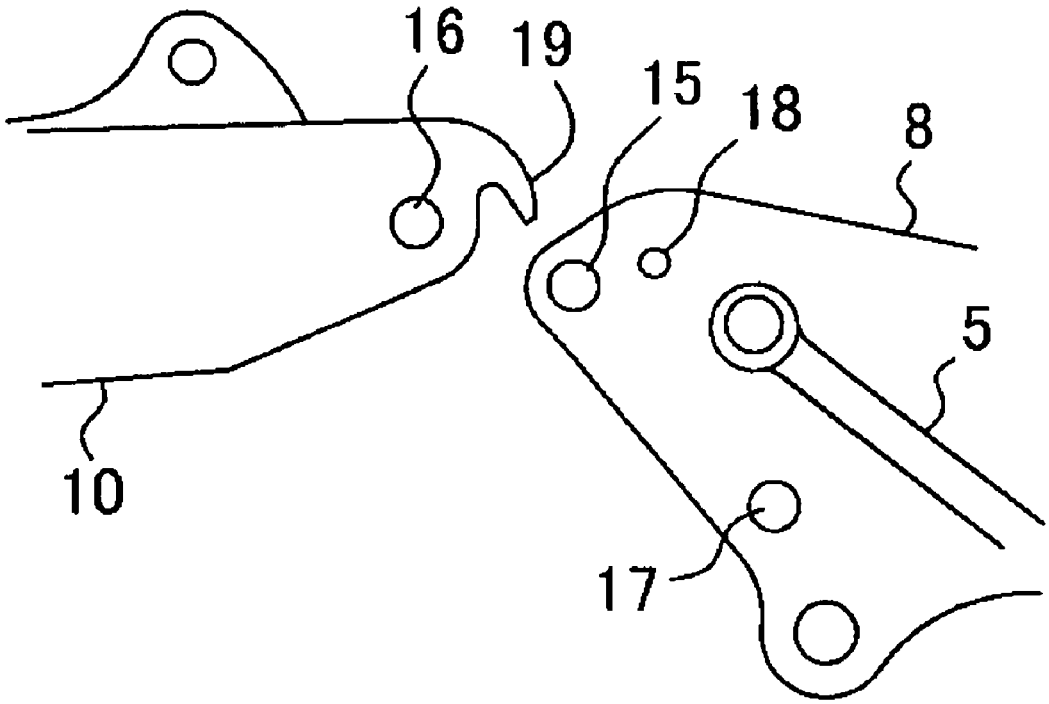
FIG. 2 is a partially enlarged view of FIG. 1.

(I) As shown in FIGS. 1 and 2, the main boom body 8 is attached to a base machine B and the front boom body 10 is supported on a mount 20 in a state that the front boom body 10 faces the main boom body 8. The figures show a case where the front boom body 10 is supported on the mount 20 in a state that the front boom body 10 and other attachment elements (an arm 2, a working device 3, an arm cylinder 6 and a working device cylinder 7) are already assembled as an example.

Figure 3:
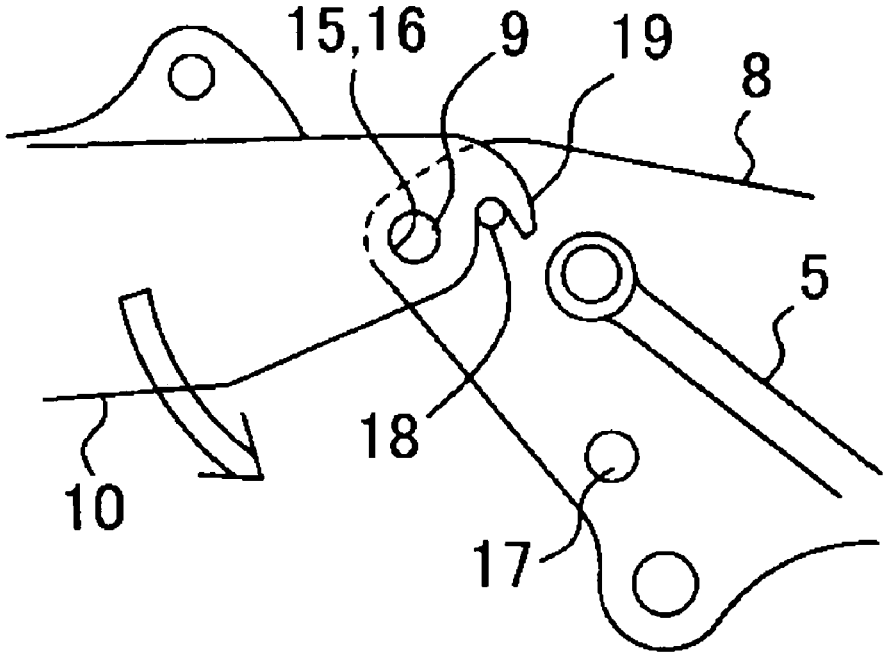
FIG. 3 is a side view showing a state that pin holes of both the boom bodies are matched by a scooping action from the state in FIG. 2.
Figure 4:
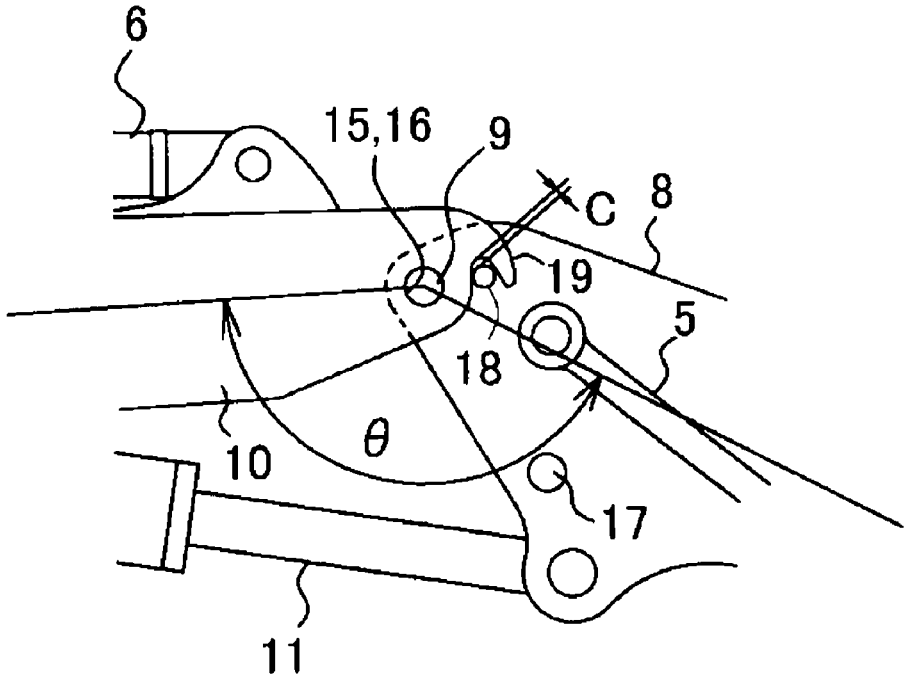
FIG. 4 is a side view showing a state that an angle between both the boom bodies is a maximum angle at the time of work by the scooping action further from the state in FIG. 3 and a second boom cylinder is attached.

(II) The base machine B is moved, and the boss 18 is engaged with the hook 19 from the lower side as shown in FIG. 3. In the above state, a first boom cylinder 5 is elongated and the main boom body 8 is rotated upward (a scooping action).

By the above scooping action, the front boom body 10 is rotated in the gradually lowering direction (downward rotation) around a center of the boss 18. Thereby, the pin holes 15 and 16 are matched with each other.

(III) The rotation spindle 9 is inserted into the matched pin holes 15 and 16 so as to connect both the boom bodies 8 and 12 on the upper side of the ends thereof.

(IV) Then, since the scooping action is further performed, the front boom body 10 is rotated downward around the rotation spindle 9. In a state that an angle θ between both the boom bodies 8 and 10 is a fixed value (such as a maximum angle at the time of work shown in FIG. 4 or a value close to the maximum angle), a second boom cylinder 11 is assembled between both the boom bodies 8 and 10 so as to complete connection.

As mentioned above, it is possible to easily and quickly match the pin holes of the both the boom bodies 8 and 10 only by the scooping action.

Figure 5:
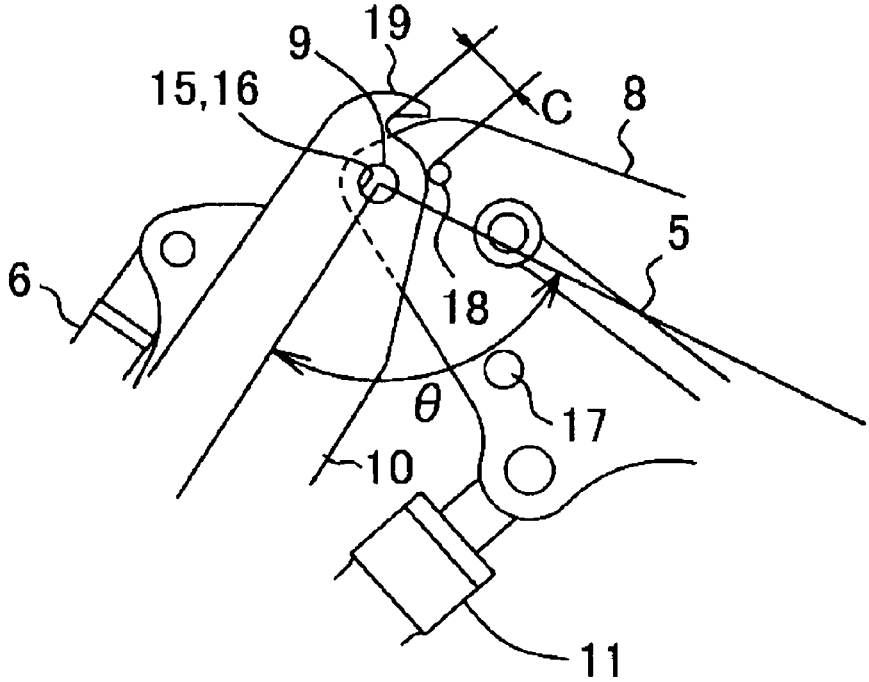
FIG. 5 is a side view showing a state that the angle between both the boom bodies is reduced from the state in FIG. 4.

In such a case, an arrangement condition of the boss 18 and the hook 19 is set as follows: "in a state that the angle θ between both the boom bodies 8 and 10 is the maximum angle at the time of work as in FIG. 4, the boss 18 and the hook 19 are moved away from each other (the character C in FIG. 4 denotes a clearance between the hook and the boss), and a distance (the clearance C) between the boss 18 and the hook 19 is increased as the angle θ between both the boom bodies 8 and 10 is reduced from the maximum angle as shown in FIG. 5."

By setting the above condition, there is no fear that downward rotation of the front boom body 10 after the connection is prevented by the boss 18 and the hook 19.

That is, it is possible to facilitate pin hole matching and ensuring a folding action of the boom at the same time.

Other Embodiments (1) In the above embodiment, the boss 18 is provided on the outer surface of the front end part of the main boom body 8. However, the above boss 18 may be provided on an inner surface of the front end part.

In such a case, needless to say, the hook 19 is provided at a position corresponding to the boss 18 in the boom width direction.

According to the above configuration, it is also possible to obtain the same effects as the first embodiment. Since an engagement part between the boss 18 and the hook 19 is positioned on the inner side of the boom, there is an advantage of preventing damage of the boss and the hook due to rubble and the like.

(2) In the above embodiment, the description is given to an example that the main boom body 8 and the front boom body 10 are connected to each other in the first attachment A1 in FIG. 6A. However, the present invention can be applied as a structure for connecting the front boom body 10 to the extension boom body 12 in a state that the extension boom body 12 is connected to the main boom body 8 in a second attachment A2 in FIG. 6B.

In such a case, the boss 18 engaged with the hook 19 of the front boom body 10 may be arranged in a front end part of the extension boom body 12 so as to satisfy the above condition.

Although the invention has been described with reference to the preferred embodiments in the attached figures, it is noted that equivalents may be employed and substitutions made herein without departing from the scope of the invention as recited in the claims.

I claim:

1. A working machine with a structure for assembling a boom thereof, the structure comprising:

a first boom body;

a second boom body connected to a front end part of said first boom body rotated by a first boom cylinder by a pin inserted into pin holes of both said boom bodies whereby said boom bodies can relatively rotate around said pin so as to be folded;

a second boom cylinder provided between both said boom bodies for rotating and folding said second boom body into a reverse V shape relative to said first boom body; and bosses provided in the front end part of said first boom body so as to extend in the boom width direction, and hooks formed in a base end part of said second boom body and opening downward, wherein said bosses may be engaged with said downward opening hooks by a scooping action of rotating said first boom body upward by said first boom cylinder, and wherein said bosses are positioned relative to said pin holes on said first boom body, and said hooks are positioned relative to said pin holes on said second boom body, such that when said pin is inserted into said matched pin holes so as to connect both said boom bodies to each other and an angle between both said boom bodies is a maximum angle at the time of work, said hooks and said bosses are located away from each other, and a distance between said hooks and said bosses is increased as the angle between both said boom bodies is reduced from the maximum angle.

2. The working machine according to claim 1, wherein in the case where a front boom body is connected to a front end part of a main boom body attached to a base machine of the working machine or an extension boom body connected to said main boom body to relatively rotate, and thereby forming the boom, said bosses and said hooks are provided for said main boom body or said extension boom body serving as said first boom body in the boom, and said front boom body serving as said second boom body therein.

* * * * *